US009367016B2

(12) United States Patent
Jones et al.

(10) Patent No.: US 9,367,016 B2
(45) Date of Patent: Jun. 14, 2016

(54) METHOD FOR CONTROLLING MEDIA BUBBLE FORMATION IN AN IMAGING DEVICE

(71) Applicant: Lexmark International, Inc., Lexington, KY (US)

(72) Inventors: Philip David Jones, Lexington, KY (US); Jeffrey Lawrence Tonges, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/253,952

(22) Filed: Apr. 16, 2014

(65) Prior Publication Data

US 2016/0004201 A1 Jan. 7, 2016

(51) Int. Cl.

| | |
|---|---|
| ***G03G 15/00*** | (2006.01) |
| ***B41J 2/01*** | (2006.01) |
| ***B65H 9/00*** | (2006.01) |

(52) U.S. Cl.
CPC ..... *G03G 15/6567* (2013.01); *B41J 2/01* (2013.01); *B65H 9/00* (2013.01); *G03G 2215/00679* (2013.01); *G03G 2215/00704* (2013.01)

(58) Field of Classification Search
USPC ..... 399/38, 42, 45, 67–70, 388, 390, 406
See application file for complete search history.

(56) References Cited

U.S. PATENT DOCUMENTS

2008/0101813 A1* 5/2008 Maul ..... G03G 15/6529 399/68

* cited by examiner

*Primary Examiner* — Hoan Tran
(74) *Attorney, Agent, or Firm* — John Victor Pezdek

(57) ABSTRACT

A method of controlling bubble formation in a media sheet between two sets of media feed roll pairs using a single media edge detector positioned downstream of the upstream media feed roll pair. The method may also be practiced using a bubble chamber positioned between the two sets of media feed roll pairs.

20 Claims, 11 Drawing Sheets

METHOD FOR CONTROLLING MEDIA BUBBLE FORMATION IN AN IMAGING DEVICE

CROSS REFERENCES TO RELATED APPLICATIONS

This patent application is related to U.S. patent application Ser. No. 14/253,947, filed Apr. 16, 2014, entitled "DUAL INPUT BUMP ALIGNMENT ASSEMBLY FOR AN IMAGING DEVICE" and assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to alignment assemblies for an imaging device, and, more particularly, to a bump alignment assembly and a method of using the same.

2. Description of the Related Art

Currently, most imaging devices position a bump align assembly in the media path prior to an image transfer station and/or a fuser to align the media prior to toned image transfer or fusing. This is done to minimize skew between the media sheet and the toned image that is to be transferred to the media sheet. An illustration of such a prior art assembly 1 is shown in FIG. 1. The media process direction is indicated by the arrow A. The plane of the media path is into the plane of the page. A bump alignment roll pair 10 is positioned downstream of a pair of spaced media guides 15, 16, while a media feed roll pair 12 is positioned upstream of the media guides 15, 16. A bubble chamber 18 is formed between media guides 15, 16. In prior art imaging devices, the bump alignment assembly 1 required that the media sheets being inputted to the bump alignment assembly 1 be from a single media path. However, most imaging devices have two or more media paths that will provide media for further processing such as toned image transfer or fusing operations. For example, media sheets may be fed from duplex path 50 formed between media guides 40, 42, 44 and along media path 52 formed between media guides 44, 46 from input media tray 30 holding a media stack MST. Also shown is a third media input path 54 between media guides 42, 44. Media path 54 may be from a multipurpose feeding tray, another option assembly, or a manual input tray. Auxiliary media feed roll pairs 14 are shown along each of paths 50 and 52 and are used to direct media sheets to media feed roll pair 12. With such an arrangement, the two input media paths 50, 52, feeding roll pair 12 need to be merged into a single media path that will allow a media sheet being fed along either media path 50, 52 to be directed into nip 13 of media feed roll pair 12. This is done through a transition section 56 provided in the media path upstream of feed nip 13 of media feed roll pair 12. Extension section 56 is shown as extensions of media guides 40, 44, and 46. The transition section 56 increases the length of the media path and the height or depth of the imaging device, depending on the orientation of the bump alignment assembly 1. As shown, the height of the imaging device would be increased, in some cases by about 45 mm or more, due to transition section 56. It would be advantageous to have a bump alignment assembly that can accommodate two or more input media paths without increasing the length of the media path and without increasing the overall height or depth of the imaging device.

Media sheet M is fed from media tray 30 through media feed roll pairs 14, 12, then between media guides 15, 16 and into bump align roll pair 10 that is either stopped or rotating opposite to the media process direction A. After the leading edge LE of the media sheet M contacts the nip 11 in bump alignment roll pair 10, media feed roll pair 12 and, if needed, media feed roll pair 14, continue to feed media sheet M into the bubble chamber 18 causing the media sheet M to buckle in a direction controlled by the media guides 15, 16, and eventually form a bubble B in bubble chamber 18. The bubble B allows the leading edge LE of media sheet M to align with the nip 11 of the bump alignment roll pair 10, deskewing the leading edge LE of media sheet M. The bump alignment roll pair 10 are then rotated to feed the media sheet M in the media process direction A for further processing.

With prior art bump alignment assemblies media edge sensors 20 having moveable arms 22 are provided by the media feed roll pair 12 and the bump alignment roll pair 10 for detecting the leading and trailing edges of the media sheet M being fed into and through the bubble chamber 18. Arms 22 are typically positioned at about 90 degrees to the media process direction across the media path. A third media sensor 23, similar to media edge sensors 20, has a specialized fan-shaped arm 24 and is provided in the bubble chamber 18 to sense and control bubble growth. The fan-shaped arm 24 is designed to be positioned at about 180 degrees with respect to media feed path so that it senses a force applied by the bubble B as it grows out from the media feed path. It would be advantageous to be able to eliminate one of the media sensors but still maintain the detection of media edges and control of bubble formation.

SUMMARY

Disclosed is a method of controlling bubble formation in a media sheet being feed into a bump alignment assembly of an imaging device or between two sets of independently driven, spaced apart media feed roll pairs having sufficient space to permit a media sheet being fed from the two sets of media feed roll pairs to buckle. In one form the method is performed with an imaging device having alignment assembly including a pair of spaced opposed media guides forming a bubble chamber therebetween and about a media path. A media feed roll pair is positioned adjacent an entrance of the chamber. An alignment roll pair is positioned downstream of and adjacent to an exit of the bubble chamber in a media process direction. The media feed roll pair is coupled to a first motor and the alignment roll pair is coupled to a second motor. A media edge sensor is positioned adjacent to and downstream of a feed nip of the media feed roll pair and has an output signal having a first state and a second state. A controller is in operative communication with the first and second motors and the media edge sensor. The method for controlling bubble formation in a media sheet comprises: initializing the media edge sensor and the output signal thereof to a first state and initializing the alignment roll pair to a first state; energizing the first motor for rotating the media feed roll pair in the media process direction for feeding the media sheet in a media process direction into the entrance of the bubble chamber using the media feed roll pair; detecting the occurrence of a change in the output signal of the first media edge sensor from the first state to the second state due to the passage of a leading edge of the media sheet; continuing feeding the media sheet into the bubble chamber in a media process direction; detecting the occurrence of a change in the output signal of the media edge sensor from the second state to the first state thereof indicating the formation of a bubble in the media sheet being fed; and upon detecting the change of state of the output signal of the media edge sensor from the second state to the first state thereof, placing the alignment roll pair into a second state.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

DETAILED DESCRIPTION

Figure 1:
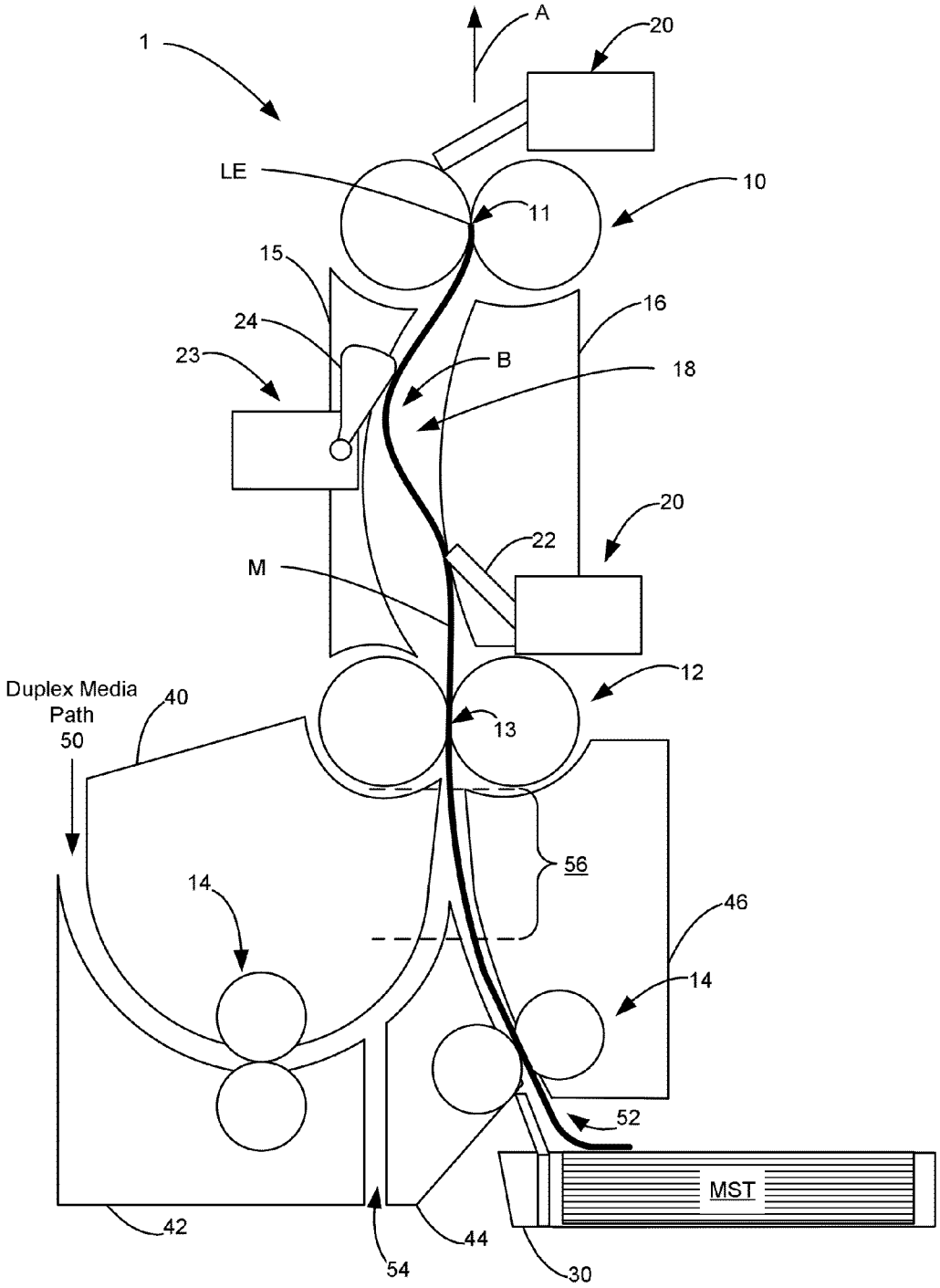
Figure 1 (Prior Art)
FIG. 1 is a schematic illustration of a prior art bump alignment assembly device.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including". "comprising", and the like are open-ended terms that indicate the presence of stated elements or features, but do not preclude additional elements or features. The articles "a", "an", and "the" are intended to include the plural as well as the singular, unless the context clearly indicates otherwise. The terms "including," "comprising," or "having" and variations thereof used herein is meant to encompass the items listed thereafter and equivalents thereof as well as additional items.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first". "second", and the like, are also used to describe various elements, regions, sections, etc. and are also not intended to be limiting. Like terms refer to like elements throughout the description.

In addition, it should be understood that embodiments of the present disclosure may include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to present example embodiments of the present disclosure and that other alternative mechanical configurations are possible.

It will be further understood that the methods described may be implemented by computer program instructions. These computer program instructions may be loaded onto a general purpose computer, special purpose computer, processor, or other programmable data processing apparatus such that the instructions which execute on the computer or other programmable data processing apparatus may create means for implementing the functionality of each action in the methods discussed in detail in the descriptions below. These computer program instructions may also be stored in a non-transitory, tangible, computer readable storage medium that may direct a computer or other programmable data processing apparatus to function in a particular manner, such that the instructions stored in the computer readable storage medium may produce an article of manufacture including an instruction means that implements the functions specified in the methods. Computer readable storage medium includes, for example, disks, CD-ROMS, Flash ROMS, nonvolatile ROM and RAM. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions of the described methods. Results of the computer program instructions may be used by other computer programs or may be displayed in a user interface or computer display of the computer or other programmable apparatus that implements the functions or the computer program instructions.

The term "output" as used herein encompasses output from any printing device such as color and black-and-white copiers, color and black-and-white printers, and multifunction devices that incorporate multiple functions such as scanning, copying, and printing capabilities in one device. Such printing devices may utilize ink jet, dot matrix, dye sublimation, laser, and any other suitable print formats. The term "button" as used herein means any component, whether a physical component or graphic user interface icon, that is engaged to initiate an action or event.

The term "image" as used herein encompasses any printed or electronic form of text, graphics, or a combination thereof "Media" or "media sheet" refers to a material that receives a printed image or, with a document to be scanned, a material containing a printed image. The media is said to move along the media path and any media path extensions from an upstream location to a downstream location as it moves from the media trays or media input areas to the output area of the imaging device. For a top feed option tray, the top of the option tray is downstream from the bottom of the option tray. Conversely, for a bottom feed option tray the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the media path. The term "media length" refers to the dimension of the media that is aligned with the media path. "Media process direction" describes the movement of media within the imaging system and is generally meant to be from an upstream location such as an input tray toward a downstream location such as an output of the imaging system. For a duplex path, the media process direction is generally from a position downstream of the print engine to a position upstream of the print engine. Further relative positional terms may be used herein. For example, "superior" means that an element is above another element. Conversely "inferior" means that an element is below or beneath another element.

Media is conveyed using pairs of aligned rolls forming feed nips. The term "nip" is used in the conventional sense to refer to the opening formed between two rolls that are located at about the same point in the media path. The rolls forming the nip may be separated apart, be tangent to each other, or form an interference fit with one another. With this nip type, the axes of the rolls are parallel to one another and are typically, but do not have to be, transverse to the media path. For example, a deskewing nip may be at an acute angle to the media feed path. The term "separated nip" refers to a nip formed between two rolls that are located at different points along the media path and have no common point of tangency with the media path. Again the axes of rotation of the rolls having a separated nip are parallel but are offset from one another along the media path. Nip gap refers to the space between two rolls. Nip gaps may be positive, where there is an opening between the two rolls, zero where the two rolls are tangentially touching or negative where there is an interference fit between the two rolls.

As used herein, the term "communication link" is used to generally refer to a structure that facilitates electronic communication between multiple components. While several communication links are shown, it is understood that a single communication link may serve the same functions as the multiple communication links that are illustrated. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Devices interconnected by a communication link may use a standard communication protocol, such as for example, universal serial bus (USB), Ethernet or IEEE 802.xx, or other communication protocols.

Figure 2:
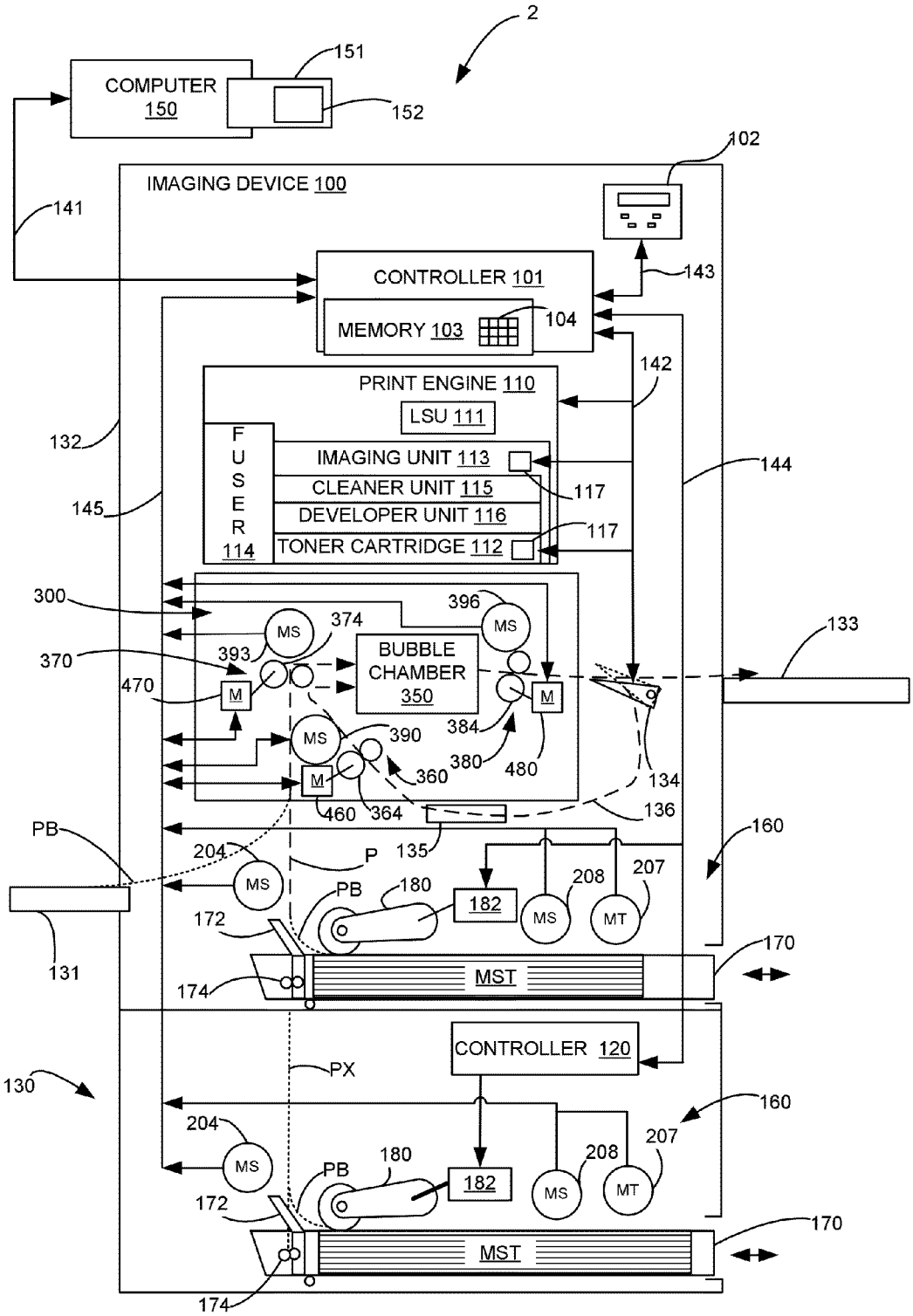
FIG. 2 is a schematic illustration of an imaging system utilizing the presently disclosed bump alignment assembly according to one example embodiment.

Referring now to the drawings and particularly to FIG. 2, there is shown a diagrammatic depiction of an imaging system 2. As shown, imaging system 2 may include an imaging device 100, and an optional computer 150 attached to the imaging device 100. Imaging system 2 may be, for example, a customer imaging system, or alternatively, a development tool used in imaging apparatus design. Imaging device 100 is shown as a printer that includes a controller 101, a print engine 110, a user interface 102, and/or one or more option assemblies 130. Imaging device 100 may also be configured to include a scanner system and various finishing options such as a stapler, and hole punch.

Controller 101 includes a processor unit and associated memory 103, and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 101. Memory 103 may contain computer programs and look-up tables 104 to be used in controlling operation of imaging device 100 or one or more of its subsystems.

In FIG. 2, controller 101 is illustrated as being communicatively coupled with computer 150 via communication link 141. Controller 101 is illustrated as being communicatively coupled with print engine 110, user interface 102 via communication links 142, 143, respectively. Computer 150 includes in its memory 151 a software program including program instructions that function as an imaging driver 152, e.g., printer/scanner driver software, for imaging device 100. Imaging driver 152 is in communication with controller 101 of imaging device 100 via communication link 141. Imaging driver 152 facilitates communication between imaging device 100 and computer 150. One aspect of imaging driver 152 may be, for example, to provide formatted print data to imaging device 100, and more particularly to print engine 110, to print an image. Another aspect of imaging driver 152 may be, for example, to facilitate collection of scanned data from a scanner system.

In some circumstances, it may be desirable to operate imaging device 100 in a standalone mode. In the standalone mode, imaging device 100 is capable of functioning without computer 150. Accordingly, all or a portion of imaging driver 152, or a similar driver, may be located in controller 101 of imaging device 100 so as to accommodate printing and/or scanning functionality when operating in the standalone mode.

Print engine 110 and user interface 102 may include firmware maintained in memory 103 which may be performed by controller 101 or another processing element. Controller 101 may be, for example, a combined printer, scanner and finisher controller. Controller 101 serves to process print data and to operate print engine 110 and its subassemblies such as laser scan unit (LSU) 111, toner cartridge 112, imaging unit 113, fuser 114, cleaner unit 115 and developer unit 116, during printing. Controller 101 may provide to computer 150 and/or to user interface 102 status indications and messages regarding the media supply media transport, imaging device 100 itself or any of its subsystems, consumables status, etc. Computer 150 may provide operating commands to imaging device 100. Computer 150 may be located nearby imaging device 100 or be remotely connected to imaging device 100 via an internal or external computer network. Imaging device 100 may also be communicatively coupled to other imaging devices.

Print engine 110 is illustrated as including LSU 111, a toner cartridge 112, an imaging unit 113, and a fuser 114, all mounted within imaging device 100. Imaging unit 113 may be removably mounted within imaging device 100 and includes a developer unit 116 that houses a toner sump and a toner delivery system. The toner delivery system includes a toner adder roll that provides toner from the toner sump to a developer roll. A doctor blade provides a metered uniform layer of toner on the surface of the developer roll. Imaging unit 113 also includes a cleaner unit 115 that houses a photoconductive drum and a waste toner removal system. Toner cartridge 112 is also removably mounted in imaging device 100 in a mating relationship with developer unit 116 of imaging unit 113. An exit port on toner cartridge 112 communicates with an entrance port on developer unit 116 allowing toner to be periodically transferred from toner cartridge 112 to resupply the toner sump in developer unit 116. Both imaging unit 113 and toner cartridge 112 may be replaceable items for imaging device 100. Imaging unit 113 and toner cartridge 112 may each have a memory device 117 mounted thereon for providing component authentication and information such as type of unit, capacity, toner type, toner loading, pages printed, etc. Memory device 117 is illustrated as being operatively coupled to controller 101 via communication link 142.

The electrophotographic imaging process is well known in the art and, therefore, will be only briefly described. During an imaging operation. LSU 111 creates a latent image by discharging portions of the charged surface of the photoconductive drum in cleaner unit 115. Toner is transferred from the toner sump in developer unit 116 to the latent image on the photoconductive drum by the developer roll to create a toned image. The toned image is then transferred either directly to a media sheet received in imaging unit 113 from one of media input trays 170 or to an intermediate transfer member 118 (see FIG. 3) and then to a media sheet. Next, the toned image is fused to the media sheet in fuser 114 and then sent to an output location 133 or a duplexer 135. One or more gates 134, illustrated as being in operable communication with controller 101 via communication link 142, are used to direct the media sheet to output location 133 or duplexer 135. Toner remnants are removed from the photoconductive drum by the waste toner removal system housed within cleaner unit 115. As toner is depleted from developer unit 116, toner is transferred from toner cartridge 112 into developer unit 116. Controller 101 provides for the coordination of these activities including media movement occurring during the imaging process.

While print engine 110 is illustrated as being an electrophotographic printer, those skilled in the art will recognize that print engine 110 may be, for example, an inkjet printer and one or more ink cartridges or ink tanks or a thermal transfer printer; other printer mechanisms and associated image forming material.

Controller 101 also communicates with a controller 120 in each option assembly 130 provided, via communication link 144. Controller 120 operates various motors housed within option assembly 130 that position media for feeding, feed media from media path branches PB into media path P or media path extensions PX as well as feed media along media path extensions PX. Controllers 101, 120 control the feeding of media along media path P and control the travel of media along media path P and media path extensions PX.

Imaging device 100 and option assembly 130 each also include a media feed system 160 having a removable media input tray 170 for holding a media stack MST, and a pick mechanism 180 with a drive mechanism 182 positioned adjacent each removable media input tray 170. Each media tray 170 also has a media dam assembly 172 and a feed roll assembly 174. In imaging device 100, pick mechanism 180 is mechanically coupled to drive mechanism 182 that is controlled by controller 101 via communication link 144. In option assembly 130, pick mechanism 180 is mechanically coupled to drive mechanism 182 that is controlled by controller 101 via controller 120 and communication link 144. In both imaging device 100 and option assembly 130, pick mechanisms 180 are illustrated in a position to drive a topmost media sheet from the media stack MST into media dam 172 which directs the picked sheet into media path P or extension PX. Bottom fed media trays may also be used. As is known, media dam 172 may or may not contain one or more separator rolls and/or separator strips used to prevent shingled feeding of media from media stack MST. Feed roll assemblies 174, comprised of two opposed rolls, feed media from an inferior unit to a superior unit via a slotted passageway provided therein.

In imaging device 100, a media path P (shown in dashed line) is provided from removable media input tray 170 extending through print engine 110 to output area 133 or to duplexer 135. Media path P may also have extensions PX and/or branches PB (shown in dotted line) from or to other removable media input trays as described herein such as that shown in option assembly 130. Media path P may include a multipurpose input tray 131 provided on housing 132 of imaging device 100 or incorporated into removable media tray 170 provided in housing 132 and a corresponding path branch PB that merges with the media path P within imaging device 100. Along media path P and its extensions PX are provided media position sensors 204 which are used to detect the position of the media, usually the leading and trailing edges of the media, as it moves along the media path P or path extension PX. Media position sensor 204 is located adjacent to the point at which media is picked from each of media trays 170. Media position sensor 204 in imaging device 100 also accommodates media fed along path branch PB from multipurpose media tray 131 and is illustrated at a position downstream of media tray 170 in imaging device 100. Additional media position sensors may be located throughout media path P and a duplex path 136, when provided, and their number and positioning is a matter of design choice. Media position sensors 204 may be an optical interrupter or a limit switch or other type of edge detector as is known to a person of skill in the art.

Media type sensors 207 are provided in imaging device 100 and each option assembly 130 to sense the type of media being fed from removable media input trays 170. Media type sensor 207 may include a light source, such as an LED and two photoreceptors. One photoreceptor is aligned with the angle of reflection of the light rays from the LED, receives specular light reflected from the surface of the sheet of media, and produces an output signal related to amount of specular light reflected. The other photoreceptor is positioned off of the angle of reflection, receives diffuse light reflected from the surface of the media and produces an output signal related to the amount of diffused light received. Controller 101, by ratioing the output signals of the two photoreceptors at each media type sensor 207, can determine the type of media in the respective media tray 170.

Media size sensors 208 are provided in image forming device 100 and each option assembly 130 to sense the size of media being feed from removable media input trays 170. To determine media sizes such as Letter, A4, A6, Legal, etc., media size sensors 208 detect the location of adjustable trailing edge media supports and may in some cases detect one or both adjustable media side edge media supports provided within removable media input trays 170 as is known in the art. Sensors 204, 207 and 208 are shown in communication with controller 101 via communication link 145.

Also shown on media path P in imaging device 100 is a bump alignment assembly 300. Bump alignment assembly 300 is comprised of spaced apart first and second media guides 310, 330, respectively, forming a bubble chamber 350 between them (see FIG. 3). A first and second media feed roll pair, 360, 370, respectively are positioned at the entrance to bubble chamber 350. First media feed roll pair 360 is positioned to receive media sheets travelling along media path 136 in duplexer 135 (see FIG. 2), while second media feed roll pair 370 is in the media path to receive media traveling along media path P from a media input tray 170 located within imaging device 100. A bump alignment roll pair 380 and first and second media feed roll pairs 360, 370 are respectively positioned at the exit and entrance of bubble chamber 350 (see FIG. 3). First and second media feed roll pairs 360, 370 and bump alignment roll pair 380 are operatively coupled to respective motors 460, 470, 480. Motors 460, 470, 480 are in operative communication with controller 101 via communication link 145 and are used to control the rotational speed and direction of rotation of these roll pairs. Positioned downstream of first and second media feed roll pairs 360, 370, are media edge sensors 390, 393, respectively. Positioned downstream of bump alignment roll pair 380 is media edge sensor 396. Media edge sensors 390, 393, 396 are, in one form, optical interrupter type sensors having arms 391, 394, 397 respectively positioned across media path P (see FIG. 3).

Figure 9:
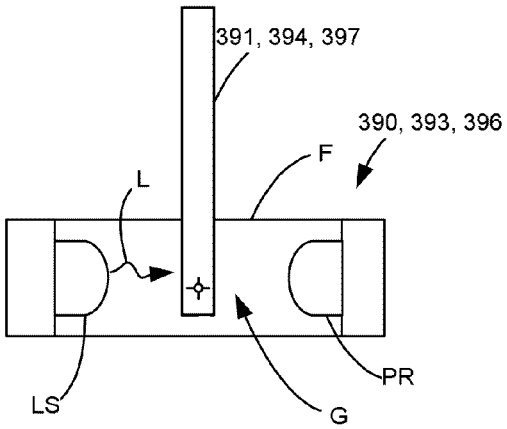
FIG. 9 is an illustration of a media edge sensor shown in a state where the light path between the light source and photoreceiver is blocked by the sensor arm.

FIG. 9 illustrates operation of one form of the media edge sensors 390, 393, 396. Sensors 390, 393, 396 have a frame F on which are mounted a light source LS and photoreceptor PR having a gap G therebetween. Light source LS may be a LED or an infrared LED. Arm 391, 394, 397 enters gap G and interrupts the light beam L between photoreceiver PR and light source LS. As shown, arm 391, 394, 397 is interrupting light beam L. As arm 391, 394, 397 enters and exits gap G, the output signal of media sensor 390, 393, 396 changes from one state to another. With the light beam blocked, the output signal of the media edge sensors 390, 393, 396 may be described as being in a second state. With the light beam unblocked, the output signal of the media edge sensors 390, 393, 396 may be described as being in a first state.

Figure 3:
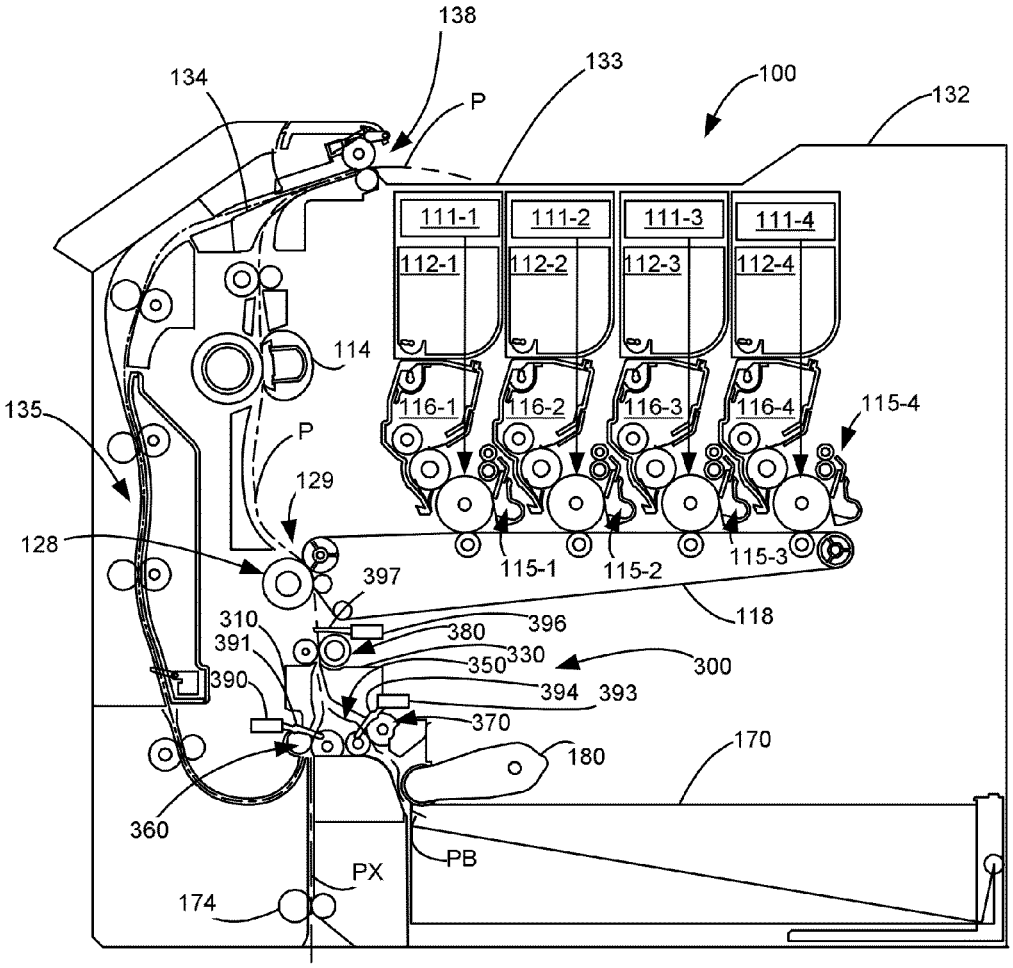
FIG. 3 illustrates an example imaging device utilizing the presently disclosed alignment assembly.

FIG. 3 illustrates imaging device 100 as a color imaging device 100 having bump alignment assembly 300 therein. Four color cartridges 112-1 through 112-4 holding black, cyan, magenta and yellow colored toners, respectively, are positioned above intermediate transfer member (ITM) 118. LSU 111-1-111-4 is provided fir each color. Corresponding developer units 116-1-116-4 and cleaner units 115-1-115-4 are positioned beneath cartridges 112-1-112-4, respectively. A transfer roll pair 128, shown at the left end of ITM 118, forms a transfer nip 129 at which the toned image on ITM 118 will be transferred to a media sheet being fed from bump alignment assembly 300. Bump alignment assembly 300 is positioned upstream of (below as shown in the figure) the transfer nip 129. Thereafter, the toned image will be fused to the media sheet as it passes through fuser 114. Provided the fused media is not undergoing duplex printing, the media sheet would then be fed past gate 134 to output area 133 via an exit roll pair 138. During duplexing, the fused media sheet would be held by exit roll pair 138 and gate 134 would be shifted so that the trailing edge of the fused media sheet would enter duplex path 136 and become the leading edge of the fused media sheet as it is transferred back to bump alignment assembly 300. Bump alignment assembly 300 receives media sheets from at least two media paths. As shown, three media paths are directed in bump alignment assembly 300. Media path 136 from duplexer 135 and path extension PX are directed to first media feed roll pair 360. Media path branch PB from media input tray 170 is directed to second media feed roll pair 370.

Figure 4:
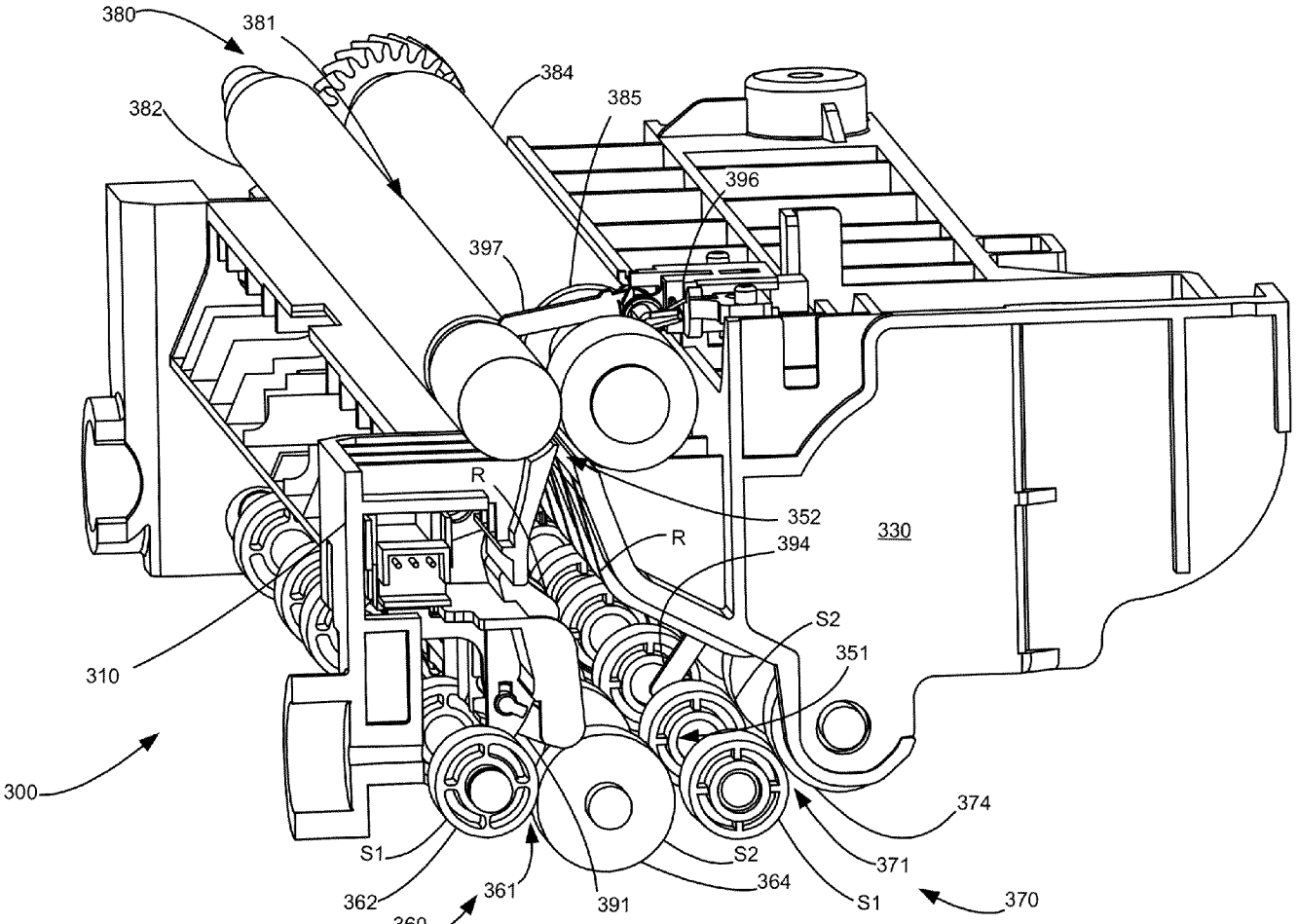
FIG. 4 is a perspective view of the bump alignment assembly illustrated in FIG. 3.

Referring to FIGS. 3-4, bump alignment assembly 300 includes two media guides 310, 330 positioned about the media path forming a bubble chamber 350 having an entrance 351 and exit 352. Exit 352 of bubble chamber 350 is upstream of fuser 114 and transfer roll pair 128. Bump alignment roll pair 380 is illustrated on media path between the exit 352 and transfer nip 129. First and second media guides 310, 330 are positioned on media path P upstream of bump alignment roll pair 380. First and second media feed roll pairs 360, 370 are positioned immediately upstream of the entrance 351 of bubble chamber 350. Respective feed nips 361, 371 of feed rolls pairs 360, 370 are positioned within the width of the entrance 351 allowing a media sheet being feed from media feed roll pair 360 or from media feed roll pair 370 to directly enter into bubble chamber 350 without the need for a transition section. This arrangement of media feed roll pairs 360, 370 and bubble chamber 350 advantageously eliminates the need to extend the media path to merge the feed paths entering each media feed roll pairs 360, 370 into a single media path prior to entry into bump alignment assembly 300.

In FIG. 4, media feed roll pairs 360, 370, are illustrated as each consisting of two opposed segmented rolls 362, 364 and 372, 374, respectively, positioned transverse to the media path P. Rolls 362, 372 are comprised of a plurality of spaced segments S1 while rolls 364, 374, are comprised of a plurality of spaced segments S2 axially aligned with segments S1. The segments S1, S2 corrugate the media sheet being fed through feed nips 361, 371 which helps to stiffen the downstream portion of the media sheet extending from the feed nips 361 or 371. Segments S1 typically are formed from a non-yielding material such as steel or hard plastic. Segments S2 typically have an outer layer made of a high friction material, such as rubber. Bump alignment roll pair 380 is comprised of two opposed non-segmented rolls 382, 384. One roll, roll 382 as shown, is typically formed from a non-yielding material such as steel or hard plastic, while the other roll, roll 384 has an outer layer 385 comprised of a high friction material similar to that used in the segments S2 of segmented rolls 364, 374. In one embodiment, each media guide, 310, 330 includes a plurality of opposed parallel ribs R extending from media guides 310 and 330 into bubble chamber 350. For purposes of illustration and not limitation, rolls 364, 374, 384 are operably coupled to respective motors 460, 470, 480 (see FIG. 2) which provide torque to rotate each respective roll pair 360, 370 and 380. In one embodiment motor 480 is reversible for purposes described in the accompanying description of the operation of bump alignment assembly 300.

Figure 5:
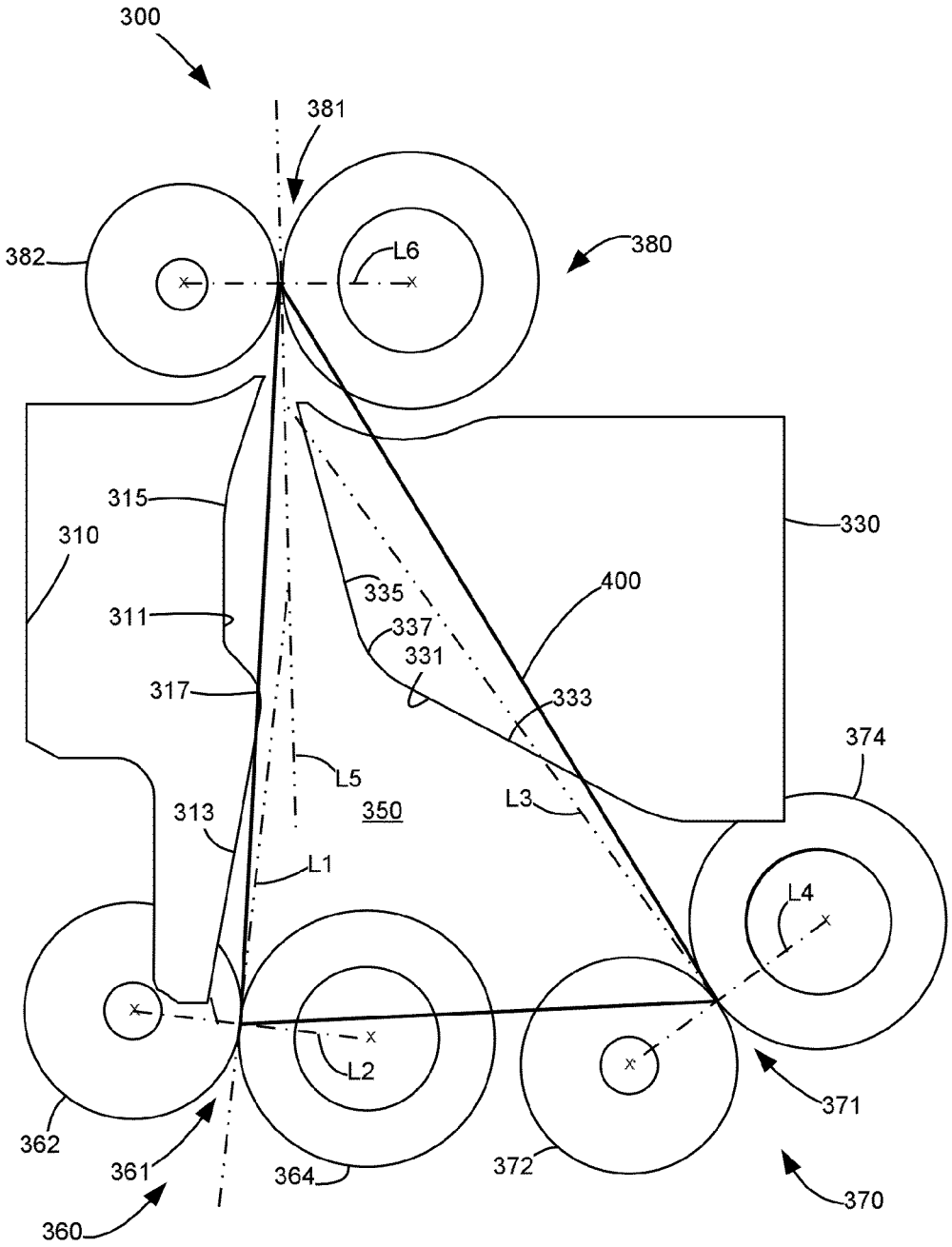
FIG. 5 is a simplified view of the bump alignment assembly of FIG. 4 illustrating the arrangement of media feed roll pairs and the bump align roll pair about the bubble chamber.

FIG. 5 illustrates the arrangement of the nips 361, 371, 381 about bubble chamber 350. The nips 361, 371, 381 form a triangle 400 having a base formed of feed nips 361, 371 as vertices and an apex at bump align nip 381. Triangle 400 has the characteristic that the altitude drawn from the apex to the base will not pass through either vertex of the base. Triangle 400 substantially encloses bubble chamber 350. Feed nips 361, 371 are positioned so that neither will be directly aligned with bump align nip 381 as would occur with a right triangular arrangement of the three nips. Also shown are three centerlines drawn from each nip. For feed nips 361, 371, centerlines L1, L3 are drawn from respective lines L2, L4 while, for bump align nip 381, centerline L5 is drawn from line L6. Line L2 is drawn through the axis of rotation of feed rolls 362, 364 and feed nip 361. Line L4 is drawn through the axis of rotation of feed rolls 372, 374, and feed nip 371. Line L6 is drawn through the axis of rotation of bump align rolls 382, 384 and bump align nip 381. The axis of rotation is indicated by the X on each roll. Centerlines L1 and L5 form an obtuse angle of less than 180 degrees as do centerlines L3 and L. This arrangement of the nips 361, 371, 381 aids in buckling of the media and bubble formation.

Figure 6:
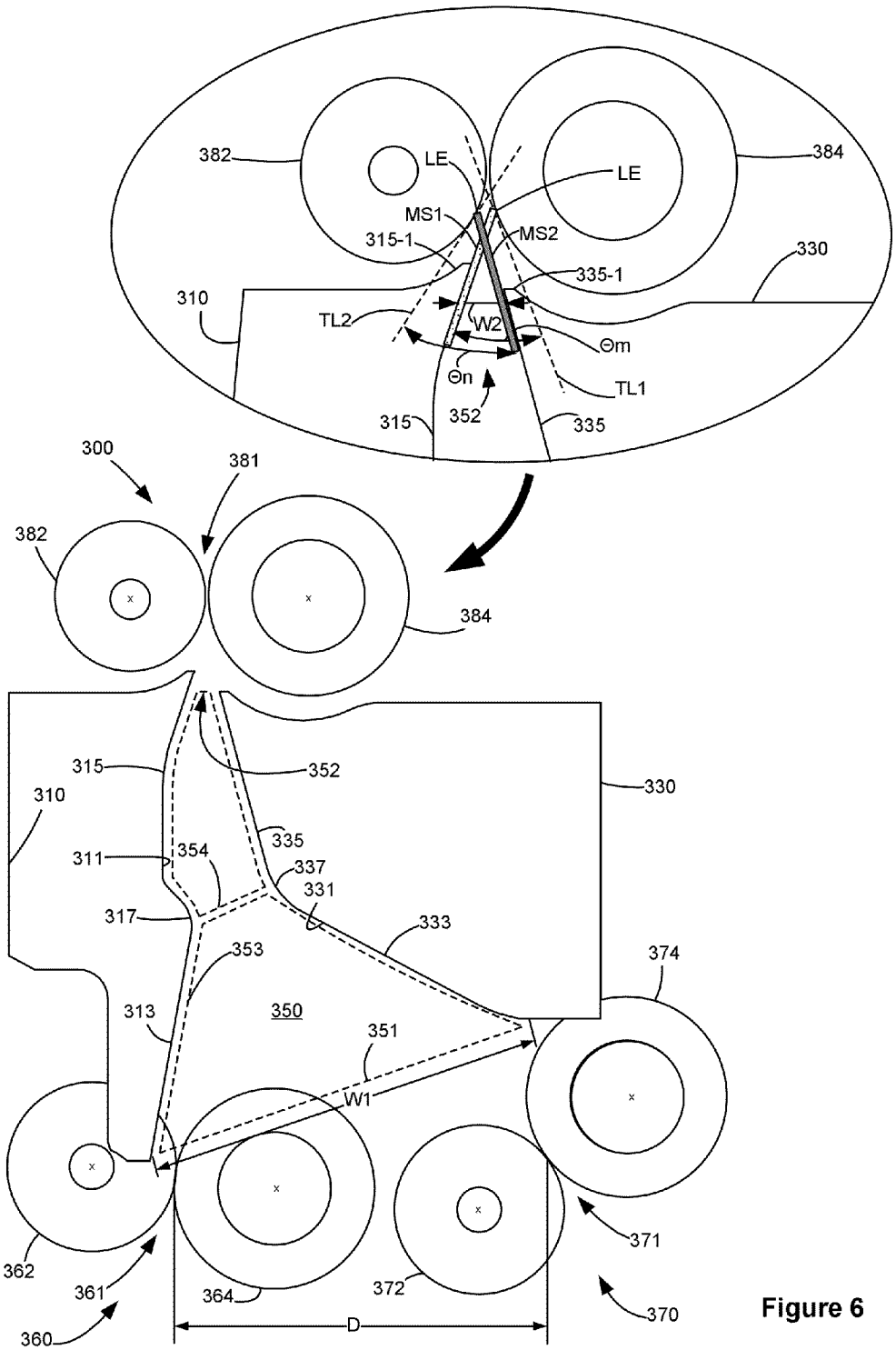
FIG. 6 is a simplified view of the bump alignment assembly of FIG. 4 including an inset illustrating media incidence angles.

FIG. 6 depicts an enlarged version of bump alignment assembly 300 to better illustrate the features of first and second media guides 310, 330 and bubble chamber 350. Opposed media guide surfaces 311, 331 of first and second media guides 310, 330, respectively, form a substantial portion of the perimeter of bubble chamber 350. Bubble chamber 350, when viewed in cross-section, has a funnel shape comprised of a wide inwardly tapering mouth 353 feeding into a narrow spout 354. The space between interior surfaces 311, 331 adjacent to respective media feed roll pairs 360, 370 define an entrance 351 into the mouth 353 of bubble chamber 350. The entrance 351 has a predetermined width W1. Feed nips 361, 371 of media feed roll pairs 360, 370, respectively, are spaced apart from each other by a nip separation distance D that is equal to or less than the width W1. This ensures that media being fed from either of feed nips 361, 371 will enter into bubble chamber 350. In one example form, width W1 may be in the range of about 25 mm to about 45 mm. The space between interior surfaces 311, 331 adjacent to bump alignment roll pair 380 defines exit 352 to the spout 354 of bubble chamber 350. The exit 352 has a predetermined width W2 (see inset of FIG. 6) that is sized to accommodate the thickest or heaviest media that will be used in the imaging device 100. Width W2 of exit 352 may be in the range of about 1.5 mm to about 5 mm.

Media guide surface 311 extends substantially between feed nip 361 and bump align nip 381 while media guide surface 331 extends substantially between feed nip 371 and bump align nip 381. Features of media guide surfaces 311, 331 aid in moving the media being fed into bubble chamber 350 from one of the two media feed roll pairs 360, 370 to buckle in a desired direction, i.e., into bubble chamber 350.

Media guide surface 311 of first media guide 310 includes an entry surface 313, an exit surface 315 that are joined by a biasing surface 317 provided approximately midway between feed nip 361 and hump align nip 381. The entry surface 313 is generally planar and may be initially contacted by a media sheet being fed from feed nip 361 of media feed roll pair 360. Entry surface 313 is angled so that the media sheet from feed nip 361 is guided toward centerline L5 of bump align nip 381 and eventually into contact with second media guide surface 333 (see FIG. 5). In one embodiment as illustrated, the entry surface 313 and centerline L5 form an obtuse angle. This ensures that the media sheet being fed from media feed roll pair 360 is directed into bubble chamber 350 and not directly into bump align nip 381.

Exit surface 315 provides a contact surface for a leading edge of a media sheet being fed from feed nip 371 of media feed roll pair 370 to bias the media sheet to buckle toward an interior of bubble chamber 350 and away from second media guide 330. Exit surface 315 has a generally concave planar shape facing bubble chamber 350. The concave shape allows the leading edge of the media being fed from feed nip 371 to strike exit surface 315 at an acute angle so that the leading edge of the media sheet will be driven toward exit 352 of bubble chamber 350 as the media sheet continues to be fed into bubble chamber 350. Although curved, exit surface 315 may be thought to approach centerline L5 at a generally acute angle. In one embodiment as illustrated, the exit surface 315 and centerline L5 form an obtuse angle. Exit surface 315 may also include an extension surface 315-1 that helps to extend exit surface 315 closer to the bump align nip 381. Extension surface 315-1 is angled toward roll 384, the roll opposite to extension surface 315-1, of bump alignment roll pair 380 to direct the leading edge LE of the media sheet fed from media feed roll pair 370 into roll 384 at angle Θm as illustrated in the inset in FIG. 6. There the media sheet being fed from media feed roll pair 370 is depicted by the light gray stippled box MS1. The angle Θm is measured between a tangent line TL1 drawn on the surface of roll 384 where media sheet MS1 will initially strike it and the path or plane of the media sheet MS1 or exit surface 315. Angle Θm is acute angle that is less than ninety degrees, for example, in the range of about 10 to about 50 degrees, to ensure that after the leading edge LE of media sheet MS1 strikes roll 384, it will be deflected in bump align nip 381. In one embodiment, the incidence angle Θm of the media sheet MS1 into alignment roll 384 is substantially equal to or less than 30 degrees.

Biasing surface 317 is a protrusion on media guide surface 311 that biases a media sheet being fed from feed nip 361 to buckle into bubble chamber 350 and away from first media guide surface 311. Biasing surface 317 may also be called a first buckle biasing surface. Biasing surface 317 serves as a transition area interconnecting entry surface 313 and exit surface 315.

Media guide surface 331 of second media guide 330 includes an entry surface 333, an exit surface 335 that are joined by a biasing surface 337 provided approximately midway between feed nip 371 and bump align nip 381. Entry surface 333 is generally planar and is initially contacted by the leading edge of a media sheet being fed from feed nip 371 of media feed roll pair 370. Entry surface 333 is angled so that the media sheet being fed from feed nip 371 is guided toward centerline L5 of bump align nip 381 and eventually into contact with first media guide surface 311, and, in particular, with exit surface 315. In one embodiment, the entry surface 333 and centerline L5 form an obtuse angle. This ensures that the media sheet fed from media fed roll pair 370 is directed into bubble chamber 350.

Exit surface 335 provides a contact surface for a leading edge of a media sheet being fed from feed nip 361 of media feed roll pair 360 to bias the media sheet to buckle toward an interior of bubble chamber 350 and away from second media guide 310. Exit surface 335 has a generally planar shape and, as illustrated in FIG. 5, forms an obtuse angle with centerline L5. This placement ensures that the media sheet being fed from feed nip 361 will strike exit surface 335 at an acute angle and be directed toward roll 382 of bump alignment roll pair 380. Exit surface 335 may also include an extension surface 335-1 that helps to extend exit surface 335 closer to the bump align nip 381. Extension surface 335-1 is angled toward roll 382, the roll opposite to extension surface 335-1, of bump alignment roll pair 380 to direct the leading edge LE of the media sheet fed from media feed roll pair 360 into roll 382 at angle Θn as illustrated in the inset in FIG. 6. There the media sheet being fed from media teed roll pair 360 media sheet is depicted by the gray box MS2. The angle Θn is measured between a tangent line TL2 drawn on the surface of roll 382 where media sheet MS2 will initially strike it and the path or plane of the media sheet MS2 or exit surface 335. Angle Θn is an acute angle that is less than ninety degrees, for example, in the range of about 10 to about 60 degrees, to ensure that after the leading edge L1 of media sheet MS2 strikes roll 382, it will be deflected in bump align nip 381. In one embodiment, the entry angle Θn of the media sheet MS1 into alignment roll 384 is substantially equal to or less than 50 degrees.

Biasing surface 337 is a protrusion of media guide surface 331 and biases a media sheet being fed from feed nip 371 to buckle into bubble chamber 350 and away from first media guide surface 331 as the leading edge of the media sheet being fed from feed nip 371 contacts exit portion 315 of first media guide 310. Biasing surface 337 may also be called a second buckle biasing surface. Biasing surface 337 serves as a transition area interconnecting entry surface 331 and exit surface 335.

The angle at which a media sheet is from respective feed nips 361, 371 is selected such that the fed media sheet approaches respective opposite media guide surfaces 331, 311 at an acute angle and allows for sufficient space for the bubble to form in the media sheet while reducing the amount of space needed for bubble formation.

FIGS. 7A-7C and 8A-8B illustrate the feeding of media sheets MS1, MS2 from feed nips 371, 361, respectively, into bump alignment assembly 300 to show buckling and bubble formation.

Figure 7A:
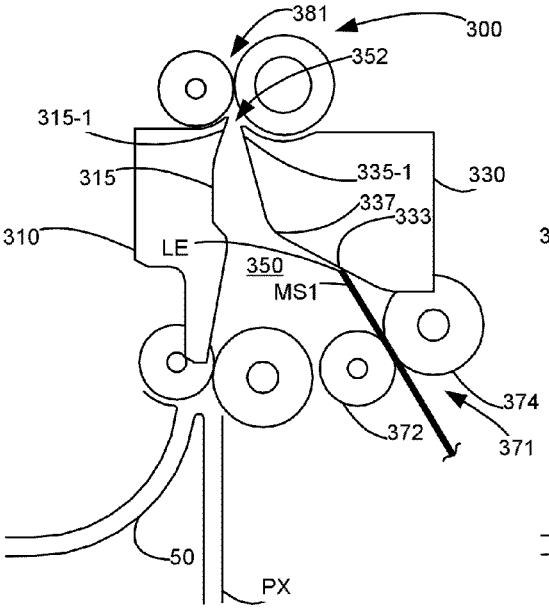
FIGS. 7A-7C illustrate bubble formation in the bump alignment assembly of FIG. 4 where a media sheet is fed from the right media feed roll pair.
Figure 7B:
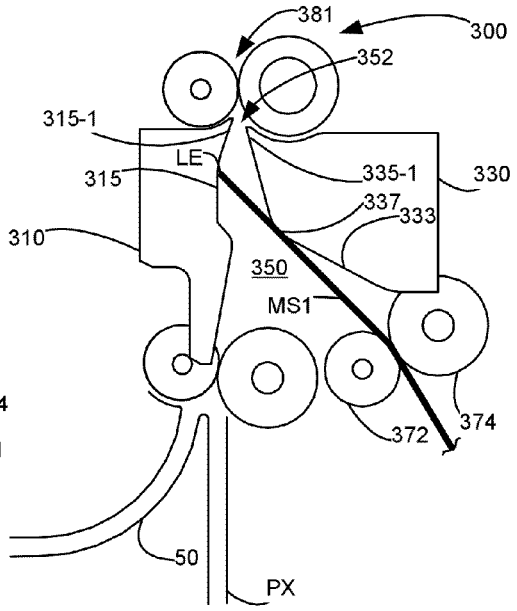
Figure 7C:
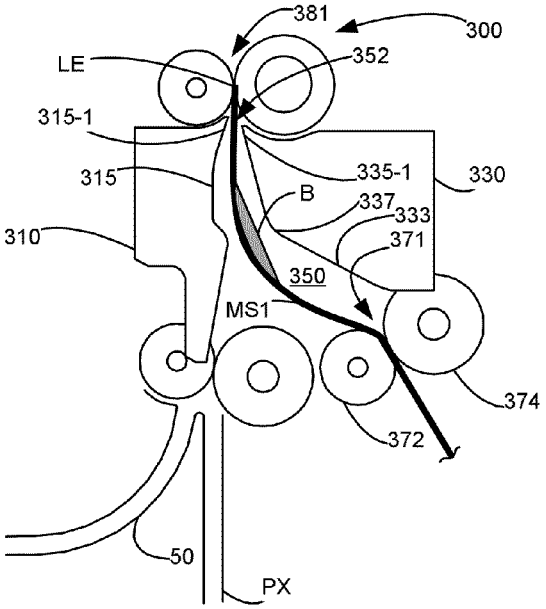

In FIG. 7A, as a media sheet MS1 is fed from feed nip 371 into bubble chamber 350, a leading edge LE thereof initially contacts entry surface 333. As illustrated in FIG. 7B, as feeding of media sheet MS1 continues, media sheet MS1 continues along entry surface 333, reaches bias surface 337 and continues on striking exit surface 315 of media guide 310. In particular, as the leading edge LE of media sheet MS1 contacts exit surface 315, the concave configuration causes a portion of media sheet MS2 to start buckling into bubble chamber 350. Biasing surface 337 prevents media sheet MS1 from buckling toward media guide 330. Thereafter, when media sheet MS1 contacts extension surface 315-1 of opposed media guide 310, media sheet MS1 is directed into roll 382 and then into bump align nip 381 as previously described and as shown in FIG. 7C allowing the bubble B, indicated by the gray sector, to grow, in turn allowing leading edge LE to align with bump align nip 381.

Figure 8A:
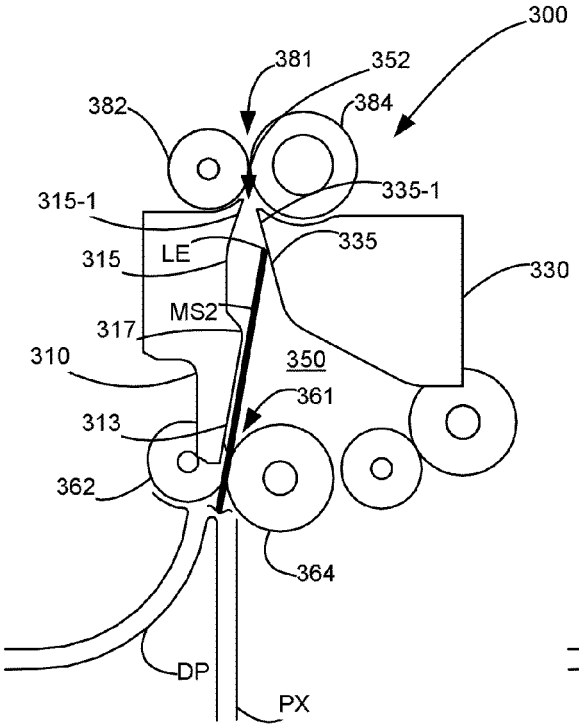
FIGS. 8A-8B illustrate bubble formation in the bump alignment assembly of FIG. 4 where a media sheet is fed from the left media feed roll pair.
Figure 8B:
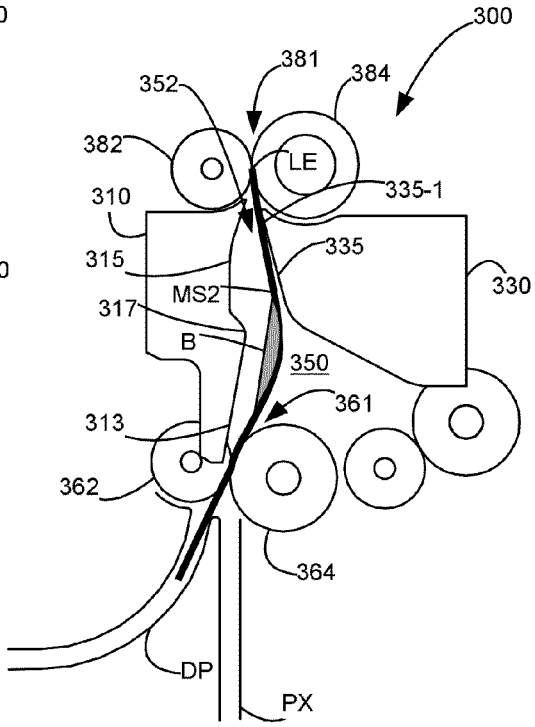

In FIG. 8A, as media sheet MS2 is fed from the feed nip 361 into bubble chamber 350, media sheet MS2 may, in some cases, contact entry surface 313 and moves therealong so as to be directed into exit surface 335 of opposed media guide 330. As feeding continues, the leading edge LE of media sheet MS2 continues to travel along extension surface 335-1 and out exit 352 and then into roll 382 as previously described. Thereafter, the leading edge LIE is directed into bump align nip 381. As feeding continues, media sheet MS2 buckles and a bubble B, indicated by the gray sector, gradually forms in bubble chamber 350 as shown in FIG. 8B. Biasing surface 317 prevents media sheet MS2 from buckling toward media guide 310. Again, bubble B formed in the portion of media sheet MS2 allows the leading edge LE of media sheet MS2 to align with bump align nip 381.

Figure 10A:
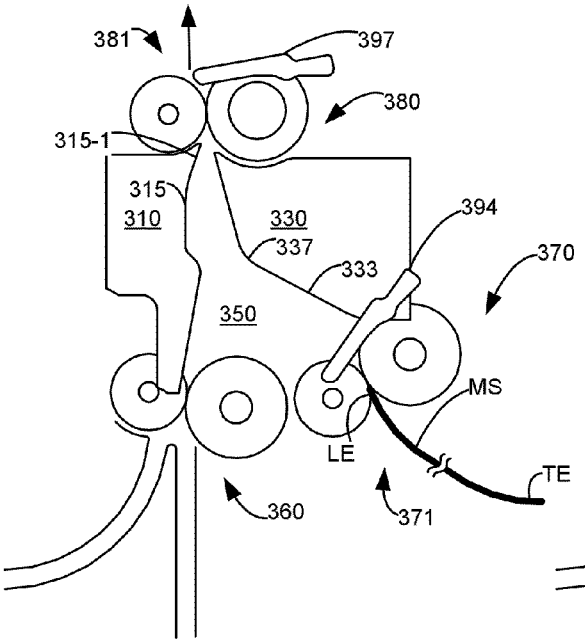
FIGS. 10A-10H illustrate methods of controlling bubble formation in a media sheet using the media edge sensor for the media feed roll pair.
Figure 10B:
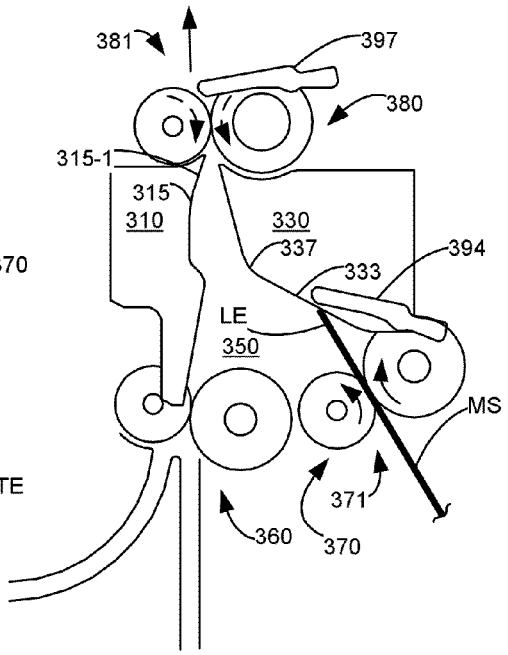
Figure 10C:
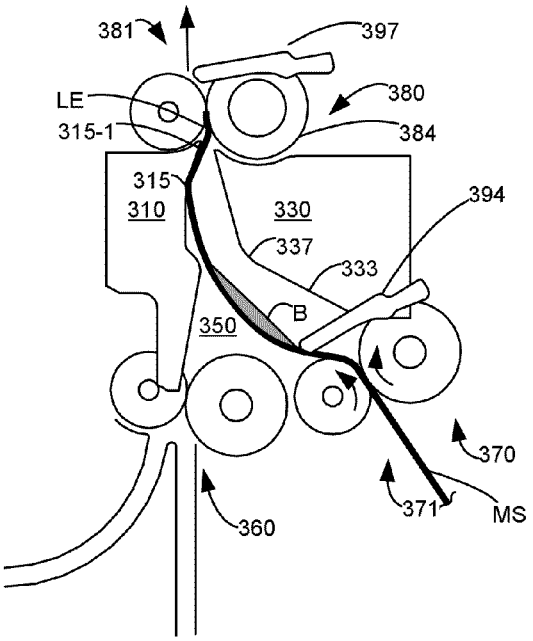
Figure 10D:
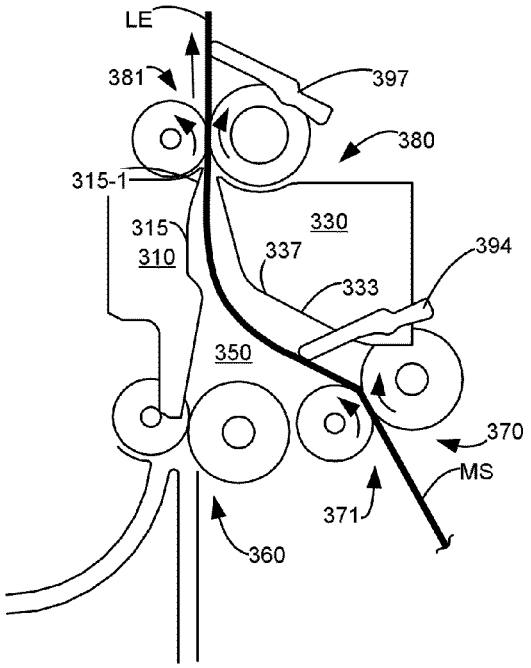
Figure 10E:
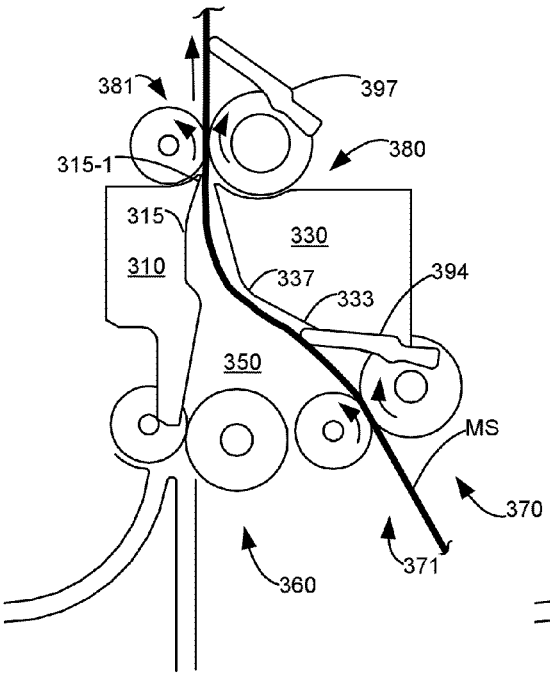
Figure 10F:
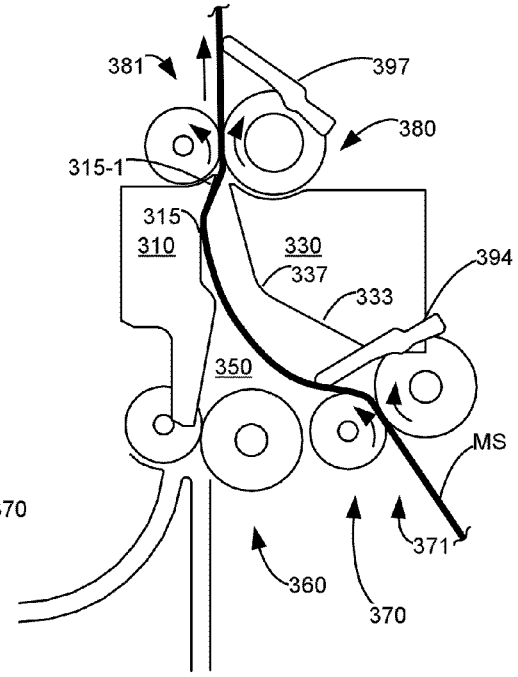
Figure 10G:
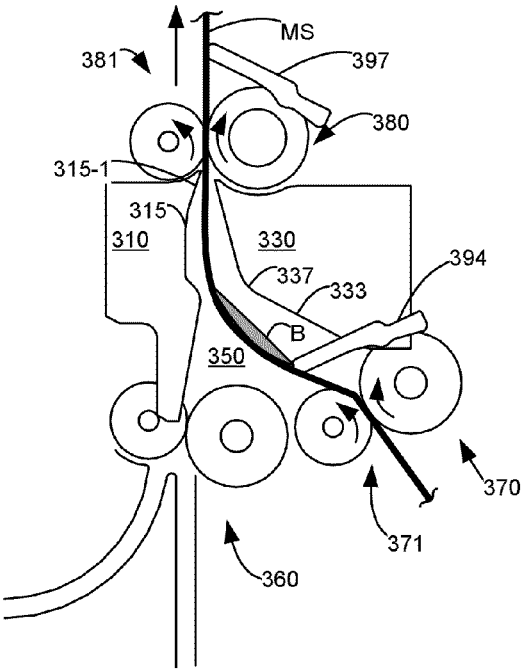
Figure 10H:
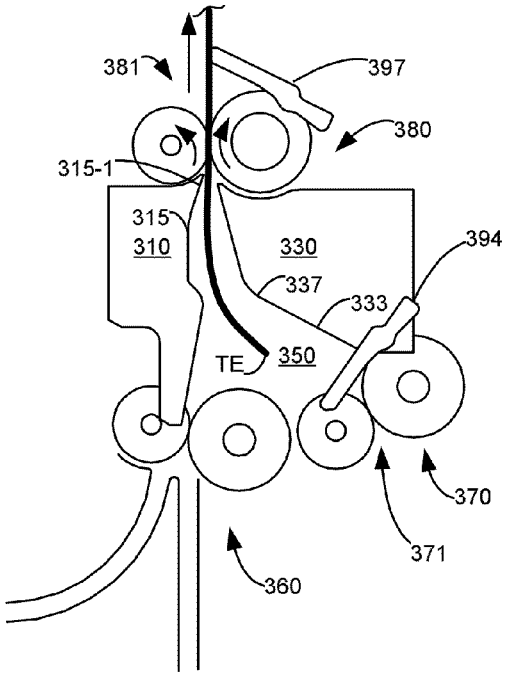
Figure 11:
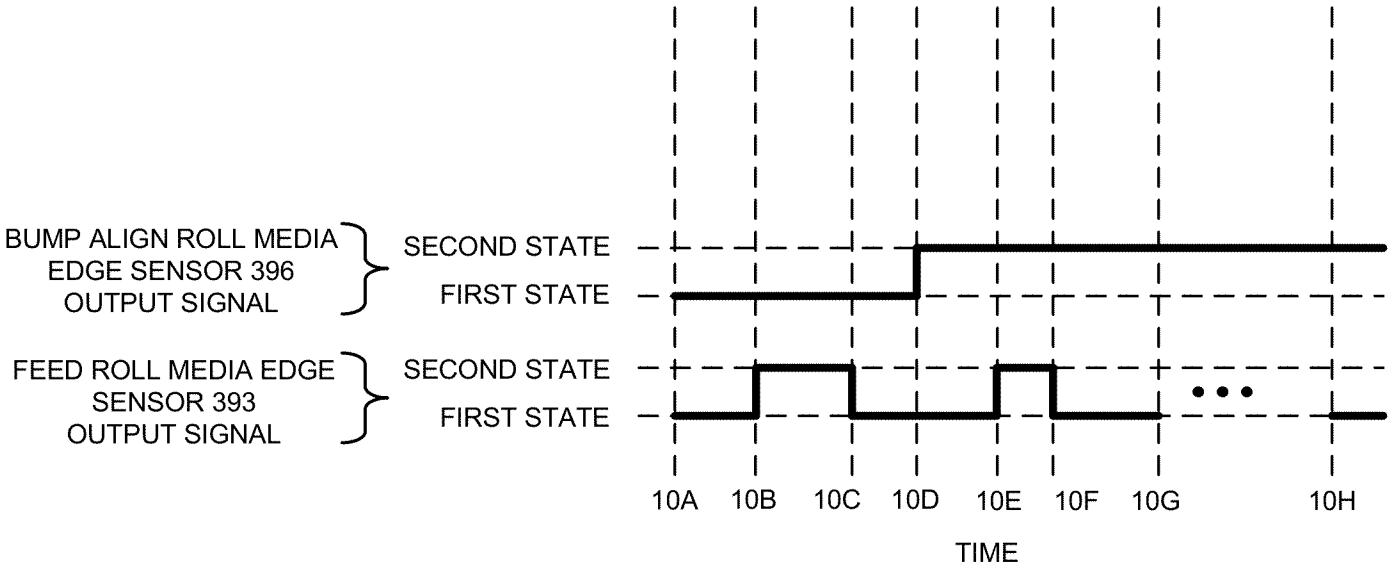
FIG. 11 is a timing diagram of the changes of state in the output signals from the media edge sensors for the bump alignment roll pair and one of the media feed roll pairs.

Referring to FIGS. 10A-10H and 11, a method of controlling bubble growth using only the media edge sensor associated with a media feed roll pair is illustrated. In FIGS. 10A-10H and 11 only operation of media edge sensors 393, 396 is shown with a media sheet being fed from media feed roll pair 370. In FIGS. 10A-10H only the positions of arms 394, 397 are shown for respective media edge sensors 393, 396. The state of the output signal of each of media edge sensors 393, 396 at each of FIGS. 10A-10H is illustrated in FIG. 11. It should be understood that similar actions occur with media edge sensors 390, 396 when a media sheet is fed from media feed roll pair 360 and will not be described further. For the following description, it should also be understood that controller 101 is controlling the rotational speed of media feed roll pairs 360, 370, and the rotation speed and direction of bump alignment roll pair 380 via respective motors 460, 470, 480. Controller 101 also communicatively coupled with and receives the output signals from media edge sensors 390, 393, 396.

In FIGS. 10A-10H, the method of bubble control is illustrated as being performed in bump alignment assembly 300. However, it should be understood: that the present method may be performed between any two sets of independently driven media feed roll pairs located along the media path where there is sufficient space between the two sets of media feed roll pairs to allow bubble formation to occur in the media sheet; that the downstream media feed roll pair need not be a bump alignment roll pair but may be the same or similar to the upstream media feed roll pair; that leading edge alignment of the media sheet need not be performed; and, that a bubble chamber formed between two media guides need not be provided between the two sets of media feed roll pairs.

In FIG. 10A, the leading edge LE of media sheet MS is shown at feed nip 371 ready to enter bubble chamber 350. The state of the output signals of both media edge sensors are in a first state at 10A in FIG. 11. Arms 394, 397 are positioned across feed nip 371 and bump align nip 381, respectively in their initial positions. Controller 101 directs motor 470 to rotate media feed roll pair 370 to feed media sheet MS into bubble chamber 350. In FIG. 10B, the leading edge LE of media sheet MS has entered into bubble chamber 350 and is shown encountering entry surface 333. Prior to that, as the leading edge LE exits feed nip 371 it contacts arm 394 moving it from an initial position and actuating media edge sensor 393 causing the output signal of media edge sensor 393 to change to a second state as indicated as 10B in FIG. 11. Controller 101 recognizes this change of state as an expected event indicating the media feeding is proceeding properly. If this change of state was not detected, controller 101 may perform one or more corrective actions such as, for example, stopping feeding of the media sheet or providing an user alert that the leading edge was not detected. The output signal of media edge sensor 397 remains in the first state. Controller 101 directs motor 470 to continue to rotate media feed roll pair 370 to continue the feeding of media sheet MS. During the operations depicted in FIGS. 10A-10C, bump alignment roll pair 380 may be stationary or, as indicated by the dashed curved arrows in FIG. 10B, be rotating counter to the media process direction indicated by the straight arrow. Buckling and bubble formation in the media sheet MS has not yet occurred.

In FIG. 10C, media sheet MS has been fed to the position where the leading edge LE has entered bump align nip 381 after encountering exit surface 315, exit extension surface 315-1 of media guide 310 and roll 384 of bump align roll pair 380. As media feed roll pair 370 continues to feed media sheet MS into bubble chamber 350, media sheet MS buckles and forms a bubble B as previously described while the leading edge LE of media sheet MS aligns with bump align nip 381. The formation of the bubble B allows arm 394 to drop back toward its initial position which causes the output signal of media edge sensor 393 to change back to its first state as shown at 10C in FIG. 11. Upon detecting the change in state in the output signal of media edge sensor 393, controller 101 either starts rotation of bump alignment roll pair 380 in the media process direction or reverses the rotation of bump alignment roll pair 380 if it was rotating in a reverse media process direction to rotate in the media process direction and begins to feed the leading edge LE of media sheet MS in the media process direction. Media sheet MS is fed from bump alignment roll pair 380 at a predetermined rate that may be faster than the rate at which media feed roll pair 370 feeds media sheet MS into bubble chamber 350.

In FIG. 10D, the leading edge LE of media sheet MS has exited bump align nip 381 and has moved arm 397 to a position where the output signal of media edge sensor 396 has changed to a second state as indicated at 10D in FIG. 11. Media edge sensor 396 will remain in this second state until the trailing edge TE of media sheet MS exits bump alignment roll pair 380. Controller 101 recognizes this change of state as an expected event indicating the media feeding is proceeding properly. If this change of state was not detected, controller 101 may perform one or more corrective actions such as, for example, stopping feeding of the media sheet or providing a user alert that the leading edge was not detected. With the more rapid feeding of media sheet MS from bump alignment roll pair 380, the bubble B in media sheet MS is reduced in size, causing media sheet to come into contact again with arm 394 of media edge sensor 393. In FIG. 10E, differential between the input feed rate and output feed rate for bubble chamber 350 has reduced the bubble B to an extent that arm 394 has returned to a position at which the output signal of media edge sensor 393 has again transitioned to the second state as indicated at 10E in FIG. 11.

Upon detecting the return of media edge sensor 393 to the second state, controller 101 may decrease the rotational rate of bump alignment roll pair 380, increase the rotational feed rate of media feed roll pair 370 or do both. The result of one of these actions is shown in FIG. 10F where the bubble has reformed in media sheet MS and arm 394 has again returned to a place where the output signal of media edge sensor 393 has returned back to a first state as indicated at 10F in FIG. 11. At FIG. 10G, the size of the bubble has decreased similar to the state shown in FIG. 10D. The process of bubble growth and deflation may occur several times during the feeding of the media when feeding is occurring from both roll pairs 370, 380. Conversely, once the bubble has been formed and then deflates, the speed of the roll pairs 370, 380 may be matched to prevent further bubble growth.

At FIG. 10H, the trailing edge TE of media sheet MS has exited feed nip 371 and bump alignment roll pair 380 will continue to feed the remainder of media sheet MS out of bubble chamber 350. Again, controller 101 may recognize this as a valid condition. For example, controller 101 knows the length of the media sheet being fed and the feed rates and can anticipate within a predetermined time range when the trailing edge TE of the media sheet will exit feed nip 371. Should this not occur within the expected time range, controller 101 may perform one or more corrective actions as previously described. For the media positions shown in FIGS. 10G and 10H, the output signal of media edge sensor 393 would remain in the first state as shown at 10G and 1 OH in FIG. 11.

The cycle would repeat for the next media sheet fed from either media feed roll pair 360 or media feed roll pair 370. Thus, by monitoring the state of the output signal of media edge sensor 393, the control of bubble growth can be accomplished using a single media edge sensor without the need for a second specialized bubble size detector.

In an alternative aspect of the present method, upon detection of the leading edge LE of the media sheet MS, the bump alignment roll pair 380 is rotated in the media process direction after a predetermined amount of media sheet MS is fed past media feed roll pair 370. For example, about 25 mm of media sheet MS may be fed past media feed roll pair 370. Controller 101 can calculate this predetermined amount based on the rotational speed of media feed roll pair 370. Upon the leading edge LE of media sheet MS being detected by media edge sensor 396, or after a predetermined amount of the media sheet MS has been fed past media feed roll pair 370, controller 101 may then rotate media feed roll pair 370 at a faster rate than the speed at which bump alignment roll pair 380 is rotating. This allows the media sheet to buckle and form a bubble. Alternatively, because controller 101 knows the feed rate of media sheet MS, it can wait a predetermined amount of time after either the leading edge LE is detected by media edge sensor 393 or after bump alignment roll pair 380 begins rotating in the media process direction and then increase the rotational speed of media feed roll pair 370 to be greater than that of bump alignment roll pair 380 and the method proceeds in a substantially similar fashion as described with respect of FIGS. 10E-10H.

Further it will be understood that when the media sheet MS is being fed by both the media feed roll pair 370 and the bump alignment roll pair 380 or by both sets of feed roll pairs as previously described, bubble formation and its growth may occur by varying the relative speeds of the two roll pairs feeding the media. To increase or decrease bubble growth, the relative speeds between the bump alignment roll pair 380 or the downstream media feed roll pair (collectively, the downstream media feed roll pair) and the media feed roll pair 370 or the upstream media feed roll pair (collectively the upstream media feed roll pair) is varied by controller 101. Generally, increasing bubble size is done by having the rotational speed of the upstream media feed roll pair being greater than the rotational speed of the downstream media feed roll pair, or, conversely, having the rotational speed of the downstream media feed roll pair being slower than the rotational speed of the upstream media feed roll pair. For example, to increase bubble size, the rotational speed of the downstream media feed roll pair may be held constant while the rotational speed of the upstream media feed roll pair is increased to be faster than the rotational speed of the downstream media feed roll pair. Also, for example, the rotational speed of the upstream media feed roll pair may be held constant while the rotational speed of the downstream media feed roll pair is decreased to be slower than the rotational speed of the upstream media feed roll pair. To decrease bubble size, the respective speeds of the downstream and upstream media feed roll pairs would be reversed.

The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. In an imaging device having a first media feed roll pair and second media feed roll pairs positioned along a media path, the second media feed roll pair being positioned downstream of the first media feed roll pair in a media process direction with the distance between the first and second media feed roll pairs having sufficient volume to allow for buckling of a media sheet therebetween, the first media feed roll pair coupled to a first motor and the second media feed roll pair coupled to a second motor, a media edge sensor positioned adjacent to and downstream of a feed nip of the first media feed roll pair, the media edge sensor having an output signal having a first state and a second state, and a controller in operative communication with the first and second motors and the media edge sensor, a method for controlling bubble formation in a media sheet being fed in the media process direction, the method comprising:

initializing the media edge sensor and the output signal thereof to a first state and initializing the second media feed roll pair to a first state;

energizing the first motor for rotating the first media feed roll pair in the media process direction for feeding the media sheet in a media process direction toward the second media feed roll pair;

detecting the occurrence of a change in the output signal of the first media edge sensor from the first state to the second state due to the passage of a leading edge of the media sheet;

continuing feeding the media sheet in a media process direction toward the second media feed roll pair;

detecting the occurrence of a change in the output signal of the media edge sensor from the second state to the first state thereof indicating the formation of a bubble in the media sheet being fed; and upon detecting the change of state of the output signal of the media edge sensor from the second state to the first state thereof, placing the second media feed roll pair into a second state.

2. The method of claim 1, wherein the first state of the second media feed roll pair is one of stopped state and a rotating state in a direction opposite to the media process direction.

3. The method of claim 1, wherein the second state of the second media feed roll pair is rotating in the media process direction.

4. The method of claim 1, wherein the first state of the second media feed roll pair is a stopped state, and, after detecting the occurrence of a change in the output signal of the first media edge sensor from the first state to the second state due to the passage of a leading edge of the media sheet and continuing feeding the media sheet in a media process direction, when the media sheet is feed past the first feed roll pair a predetermined amount, rotating the second media feed roll pair in the media process direction.

5. The method of claim 4 wherein after a predetermined amount of time after the leading edge of the media is detected, performing one of rotating the second media feed roll pair at a slower speed than the first media feed roll pair and rotating the first media feed roll pair at a higher speed than the second media feed roll pair.

6. The method of claim 1, wherein, when the occurrence of a change in the output signal of the media edge sensor from the first state to the second state due to the passage of a leading edge of the media sheet is not detected, providing an error indication.

7. The method of claim 1, wherein, when the occurrence of a change in the output signal of the media edge sensor from the second state to the first state is not detected, providing an error indication.

8. In an imaging device having an alignment assembly including a pair of spaced opposed media guides forming a bubble chamber therebetween and about a media path, a media feed roll pair positioned adjacent an entrance of the chamber, an alignment roll pair positioned downstream of and adjacent to an exit of the bubble chamber in a media process direction, the media feed roll pair coupled to a first motor and the alignment roll pair coupled to a second motor, a media edge sensor positioned adjacent to and downstream of a feed nip of the media feed roll pair, the media edge sensor having an output signal having a first state and a second state, and a controller in operative communication with the first and second motors and the media edge sensor, a method for controlling bubble formation in a media sheet being fed in the media process direction, the method comprising:

initializing the media edge sensor and the output signal thereof to a first state and initializing the alignment roll pair to a first state;

energizing the first motor for rotating the media feed roll pair in the media process direction for feeding the media sheet in a media process direction into the entrance of the bubble chamber;

detecting the occurrence of a change in the output signal of the first media edge sensor from the first state to the second state due to the passage of a leading edge of the media sheet;

continuing feeding the media sheet into the bubble chamber in a media process direction;

detecting the occurrence of a change in the output signal of the media edge sensor from the second state to the first state thereof indicating the formation of a bubble in the media sheet being fed; and, upon detecting the change of state of the output signal of the media edge sensor from the second state to the first state thereof, placing the alignment roll pair into a second state.

9. The method of claim 8, wherein the first state of the alignment roll pair is one of stopped state and a rotating state in a direction opposite to the media process direction.

10. The method of claim 8, wherein the second state of the alignment roll pair is rotating in the media process direction.

11. The method of claim 8, wherein, when the occurrence of a change in the output signal of the first media edge sensor from the first state to the second state due to the passage of a leading edge of the media sheet is not detected, providing an error indication.

12. The method of claim 8, wherein, when the occurrence of a change in the output signal of the first media edge sensor from the second state to the first state is not detected, providing an error indication.

13. In an imaging device having an alignment assembly including a pair of spaced opposed media guides forming a bubble chamber about a media path, a motor-driven media feed roll pair positioned adjacent an entrance of the bubble chamber, a motor driven alignment roll pair positioned downstream of and adjacent to an exit of the bubble chamber in a media process direction, a first media edge sensor positioned adjacent to and downstream of a feed nip of the media feed roll pair, the first media edge sensor having an output signal having a first state and a second state, and a controller operatively coupled with the media feed roll pair, the alignment roll pair and the first media edge sensor, a method for controlling bubble formation in a media sheet being fed through the bubble chamber in the media process direction, the method comprising:

initializing the output signal of the first media edge sensor to the first state thereof;

rotating the alignment roll pair in a direction opposite to the media process direction;

feeding of the media sheet from the media feed roll pair into the bubble chamber by driving the media feed roll pair in the media process direction;

detecting the occurrence of the output signal of the first media edge sensor changing from the first state to the second state thereof due to the passage of a leading edge of the media sheet;

continuing feeding the media sheet into the bubble chamber in a media process direction;

detecting the occurrence of the output signal of the first media edge sensor changing from the second state to the first state thereof indicating the formation of a bubble in the media sheet being fed; and, upon detecting the change of state of the output signal of the first media edge sensor from the second state to the first state thereof, rotating the alignment roll pair in the media process direction.

14. The method of claim 13, wherein, when the occurrence of a change in the output signal of the first media edge sensor from the first state to the second state due to the passage of a leading edge of the media sheet is not detected, providing an error indication.

15. The method of claim 13, wherein, when the occurrence of a change in the output signal of the first media edge sensor from the second state to the first state is not detected, providing an error indication.

16. In an imaging device having an alignment assembly including a pair of spaced opposed media guides forming a bubble chamber about a media path, a motor-driven media feed roll pair positioned adjacent an entrance of the chamber, a motor-driven alignment roll pair positioned downstream of and adjacent to an exit of the bubble chamber in a media process direction, a first media edge sensor positioned downstream of a feed nip of the media feed roll pair and a second media edge sensor positioned adjacent a feed nip of the alignment roll pair, the first and second media edge sensors each having an output signal having a first state and a second state, the media feed roll pair, the alignment roll pair and the first and second media edge sensors being operatively coupled to a controller, a method for controlling bubble formation in a media sheet being fed through the bubble chamber in the media process direction, the method comprising:

initializing the first and second media edge sensors and the alignment roll pair to respective first states;

feeding the media sheet into the entrance of the bubble chamber using the media feed roll pair rotating at a first predetermined speed;

detecting the occurrence of the output signal of the first media edge sensor changing from the first state to the second state thereof due to the passage of a leading edge of the media sheet;

continuing feeding the media sheet into the bubble chamber in a media process direction;

detecting the occurrence of the output signal of the first media edge sensor changing from the second state to the first state thereof indicating the formation of a bubble in the media sheet being fed;

upon detecting the change of state of the output signal of the first media edge sensor from the second state to the first state thereof, placing the alignment roll pair into a second state to feed the media sheet in the media process direction from the bubble chamber at a second predetermined speed;

detecting the occurrence of the output signal of the second media edge sensor changing from the first state to the second state;

upon detecting the output signal of the second media edge sensor changing to the second state, continuing feeding of the media sheet from the media feed roll pair and from the alignment roll pair;

detecting the occurrence of the output signal of the first media sensor changing from the first state to the second state thereof;

upon detecting the change of state of the output signal of the first media edge sensor from the first state to a second state thereof, performing one of increasing the rotational speed of the media feed roll pair to be greater than the rotational speed of the alignment roll pair and decreasing the rotational speed of the alignment roll pair to be less than the rotational speed of the media feed roll pair;

detecting the occurrence of the output signal of the first media edge sensor changing from the second state to the first state thereof; and, upon detecting the change of state of the output signal of the first media edge sensor from the second state to the first state thereof, performing one of decreasing the rotational speed of the media feed roll pair to be less than the rotational speed of the alignment roll pair and increasing the rotational speed of the alignment roll pair to be greater than the rotational speed of the media feed roll pair.

17. The method of claim 16, wherein the operations of:

detecting the occurrence of the output signal of the first media sensor changing from the first state to the second state thereof, performing one of increasing the rotational speed of the media feed roll pair to be greater than the rotational speed of the alignment roll pair and decreasing the rotational speed of the alignment roll pair to be less than the rotational speed of the media feed roll pair, detecting the occurrence of the output signal of the first media edge sensor changing from the second state to the first state thereof, and, performing one of decreasing the rotational speed of the media feed roll pair to be less than the rotational speed of the alignment roll pair and increasing the rotational speed of the alignment roll pair to be greater than the rotational speed of the media feed roll pair, are repeated until a trailing edge of the media sheet being feed from the media feed roll pair has been detected by the first media edge sensor.

18. The method of claim 17, wherein, when the occurrence of a change in the output signal of the first media edge sensor from the first state to the second state due to the passage of a leading edge of the media sheet is not detected, providing an error indication.

19. The method of claim 17, wherein, when the occurrence of a change in the output signal of the first media edge sensor from the second state to the first state is not detected, providing an error indication.

20. The method of claim 17, wherein, when the occurrence of a change in the output signal of the second media edge sensor from the first state to the second state is not detected, providing an error indication.

* * * * *